United States Patent [19]

Marabotto et al.

[11] Patent Number: 4,690,471

[45] Date of Patent: Sep. 1, 1987

[54] RF INTERCONNECT WITH TRIAXIAL SELF-ALIGNMENT

[75] Inventors: Eduardo J. Marabotto, Miami; Mark S. Bresin, Coral Springs, both of Fla.

[73] Assignee: Motorola, Inc., Schaumburg, Ill.

[21] Appl. No.: 864,239

[22] Filed: May 19, 1986

[51] Int. Cl.[4] ..... H01R 9/09

[52] U.S. Cl. ..... 439/63; 439/246; 439/544

[58] Field of Search ..... 339/17 R, 17 C, 17 D, 339/17 LC, 64 R, 64 M, 125 R, 125 L, 12 G, 12 R, 12 J, 128, 129, 130 R, 130 C, 132 R, 132 B, 132 T, 134, 5 R, 5 P, 8 R, 8 P; 248/27.1, 27.3

[56] References Cited

U.S. PATENT DOCUMENTS

| | | | |
|---|---|---|---|
| 973,817 | 10/1910 | Russell | 339/126 R |
| 2,093,663 | 9/1937 | Suzuki | 339/177 L |
| 2,499,296 | 2/1950 | Buchanan | 339/17 LC |
| 2,782,389 | 2/1957 | Sunko et al. | 339/17 D |
| 2,869,090 | 1/1959 | Johanson | 339/17 R |
| 2,932,819 | 4/1960 | Steel | 339/64 R |
| 3,107,965 | 10/1963 | Solorow et al. | 339/17 R |
| 3,426,310 | 2/1969 | Takeuchi et al. | 339/17 R |
| 4,219,172 | 8/1980 | Murayama | 339/17 C |
| 4,413,529 | 11/1983 | Bissell | 248/27.1 |

*Primary Examiner*—Neil Abrams

*Attorney, Agent, or Firm*—Martin J. McKinley; Daniel K. Nichols; Joseph T. Downey

[57] ABSTRACT

An RF interconnect between a printed circuit board and a coaxial connector mounted in a housing is self-aligning along all three major axes. The coaxial connector has a pin connected to its inner conductor that extends beyond the edge of the outer conductor. The outer conductor has an external circumferential groove. The interconnect includes two terminals wherein the first terminal includes a substantially "M" shaped wire formed conductor having five functional segments: two flexible attaching segments near the ends of the wire, two substantially parallel pin contact segments, and a joining segment connecting the pin contact segments. The coaxial connector pin is inserted between the parallel pin contact segments of the wire formed conductor and a clamping force is generated on the pin by the joining segment. The second terminal includes a flat flexible conductor that has a "U" shaped lug at one end and a snap ring at the other end which is inserted into the groove of the coaxial connector. The flexible conductor is attached to the printed circuit board by passing a screw through the opening in the lug and threading it into a plated through hole in the printed circuit board.

6 Claims, 1 Drawing Figure

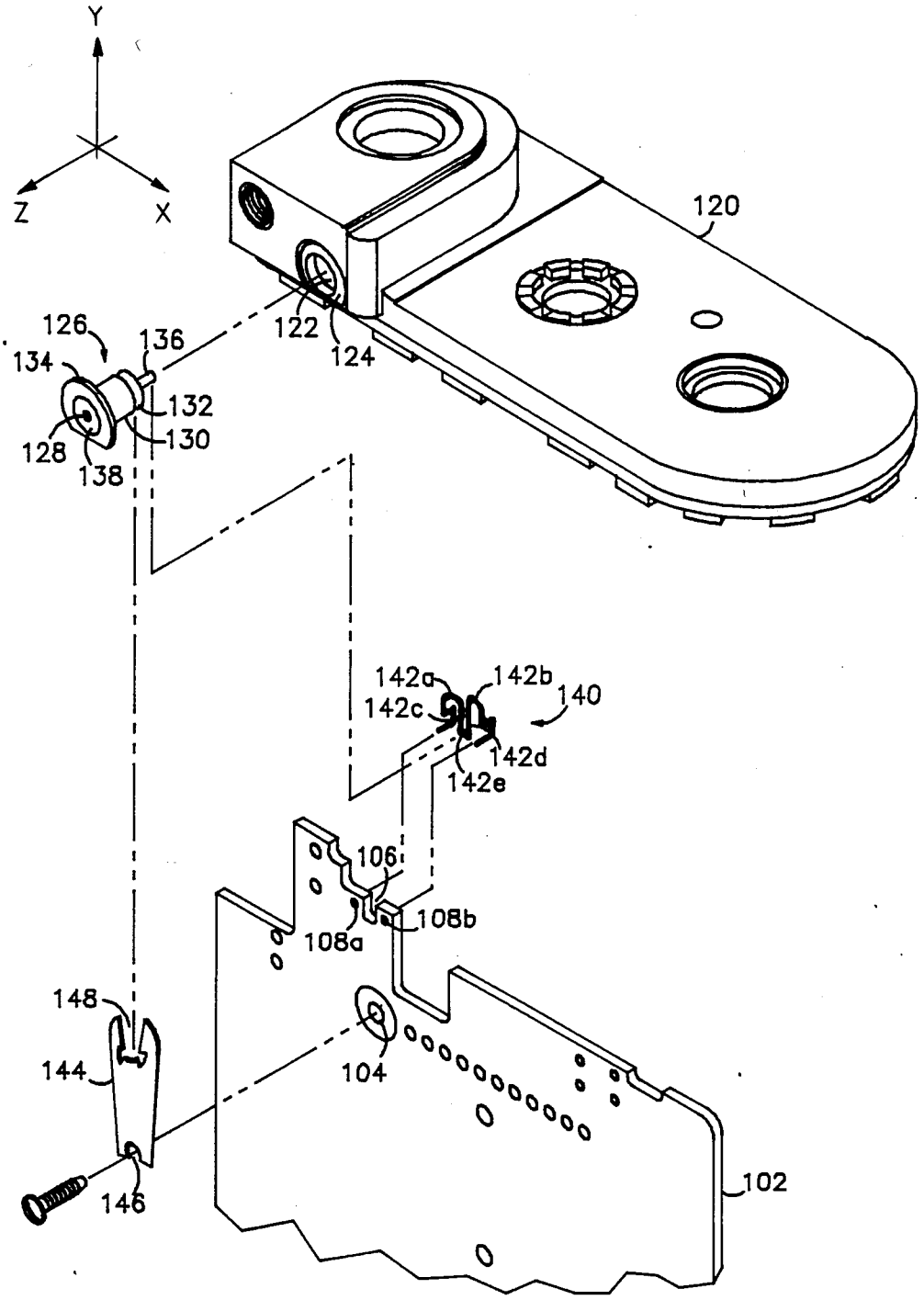
Y
Z
X
120
122
124
126
134
136
132
130
128
138
142a
142b
140
142c
142d
142e
106
108a
108b
148
144
104
146
102

RF INTERCONNECT WITH TRIAXIAL SELF-ALIGNMENT

BACKGROUND OF THE INVENTION

This invention relates to the field of electrical connectors and more particularly to radio frequency (RF) connectors that find application in portable radio transceivers.

Portable radio transceivers usually include a durable plastic outer housing which contains a main printed circuit board attached to a rectangular frame. The housing is typically divided into at least two sections with one section being removable to facilitate assembly and repair of the radio transceiver. An external RF connector is typically attached to the housing, such that an external antenna or a radio test fixture can be attached directly to the RF input/output (i.e. antenna terminal) of the radio transceiver.

In the past, coaxial cable has been used to interconnect the printed circuit board and the external RF connector. Although coaxial cable usually provides a good electrical interconnection between the printed circuit board and the external RF connector, the use of coaxial cable creates problems in the manufacture of the radio transceiver because it requires a separate soldering and wire stripping operation which is usually done by hand.

It would be desirable, therefore, to have an interconnect that could be entirely machine assembled, have substantially 50 Ohm impedance at the desired frequency, and allow for easy disassembly in the event that repair is necessary. Because of inherent dimensional manufacturing tolerances between the housing which contains the external RF connector, and the frame assembly with attached printed circuit board, it would also be advantageous if this interconnect could compensate for any misalignment between the housing and the frame assembly while still maintaining good electrical contact. Because misalignment can occur in any direction, it would also be desirable for this interconnect to provide for "three-dimensional" or "triaxial" self-alignment; that is, to provide self-alignment in any direction parallel to any one of three perpendicular axes or any combination of those three directions.

SUMMARY OF THE INVENTION

Briefly, the invention is a triaxial self-aligning interconnect for connecting a circuit substrate to a connector that has a pin and a groove. The invention includes a first terminal that has a wire conductor which is formed into five segments. Two of the segments are flexible attaching segments that are formed at the ends of the wires. The flexible attaching segments flexibly attach the first terminal to the circuit substrate. Adjoining the flexible attaching segments are two parallel pin contact segments which are connected by a joining segment. An electrical connection is formed between the connector and the first terminal when the pin is inserted between the pin contact segments. Substantial misalignment of the substrate and the connector is permitted in any direction without breaking the electrical connection.

In another embodiment, a triaxial self-aligning interconnect includes a housing with an aperture. A connector with a groove is positioned in the housing aperture. A substrate is included that has an electrical circuit pattern. A flexible conductor has a "U" shaped lug at one end which is fastened to the substrate. The flexible connector also has a snap ring at the opposite end which is engaged with the groove of the connector. This forms an electrical connection between the connector and the substrate circuit pattern and also retains the connector within the housing. Substantial misalignment of the substrate and the connector is permitted in any direction without breaking the electrical connection.

In another embodiment, a triaxial self-aligning interconnect includes a housing with an aperture into which a coaxial connector is positioned. The coaxial connector has inner and outer concentric conductors. A substrate with an electrical circuit pattern is also included. Inner conductor connecting means provide an electrical connection between the inner conductor and the substrate circuit pattern. An outer conductor connecting means provides an electrical connection between the outer conductor and the substrate circuit pattern. Substantial misalignment of the substrate and the housing is permitted without breaking the electrical connection between the substrate and the inner conductor or the substrate and the outer conductor.

In still another embodiment, a triaxial self-aligning interconnect includes a housing having an aperture into which a coaxial connector is inserted. The coaxial connector has a flange to position the connector in the aperture. The connector includes inner and outer concentric conductors and a pin that is attached to the inner conductor. The pin extends beyond the end of the outer conductor. The outer conductor has an external circumferential groove. A substrate is included that has an electrical circuit pattern and a hole. A wire conductor is attached to the substrate and is electrically connected to the circuit pattern at the ends of the wire conductor. The wire conductor is formed into five segments: two flexible segments formed near the end of the wires adjoin two substantially parallel pin contact segments. The pin of the coaxial connector is positioned between the pin contact segments, and a joining segment mutually connects the pin contact segments and generates a clamping force of the pin, thereby forming an electrical connection between the inner conductor and the substrate circuit pattern. A substantially flat flexible conductor has a "U" shaped lug at one end and a snap ring at the opposite end which is engaged with the groove of the coaxial connector. This retains the coaxial connector within the aperture of the housing. A fastener is inserted into the hole of the substrate to attach the lug to the substrate and form an electrical connection between the outer conductor and the substrate circuit pattern. Substantial misalignment of the substrate and the connector is permitted in any direction without breaking the electrical connections.

BRIEF DESCRIPTION OF THE DRAWINGS

The FIGURE is an exploded perspective view of the present invention.

DESCRIPTION OF THE PREFERRED EMBODIMENT

Referring to the FIGURE, a circuit substrate 102, preferably a printed circuit board, has a large plated through hole 104, a notch 106, and two smaller plated through holes 108*a* and 108*b* positioned on opposite sides of the notch. An electrical circuit pattern (not illustrated) is printed on one or both surfaces of printed circuit board 102. The electrical circuit pattern is appropriately connected to plated through holes 104, 108*a* and 108*b*.

An upper housing part 120 is preferably molded from a blended PC-PET polycarbonate polyester such as Mobay Chemical Corporation's "Marko Blend DP4-1357". Housing part 120 has an aperture 122 with a recessed portion 124. An RF connector 126 has an inner conductor 128 and an outer conductor 130. The outer conductor has an external circumferential groove 132 and a flange 134. Hole 122 in housing part 120 is sized to receive outer conductor 130 and recess 124 is sized to receive flange 134. One function of flange 134 is to properly position connector 126 in aperture 122. An "O" ring (not illustrated) is inserted behind flange 134 to provide for a water-tight seal between RF connector 126 and housing part 120. A pin 136 is connected to inner conductor 128 and extends beyond the edge of outer conductor 130. Inner conductor 128, outer conductor 130, flange 134, and pin 136 are constructed from nickel-silver with a copper and nickel undercoating and a gold plated finish. In between inner conductor 128 and outer conductor 130 is a dielectric 138 having a dielectric constant of 3.1. Dielectric 138 is preferably a polyester thermo-plastic such as VALOX 760 (VALOX 760 is a trademark of the General Electric Corporation).

The diameter of inner conductor 128 is approximately 1 millimeter, although minor abrupt variations in the diameter of the conductor prevent it from being forced out of dielectric 138. Outer conductor 130 has an inside diameter of approximately 2.87 millimeters and an outside diameter of 4.19 millimeters. The outside diameter of circumferential groove 132 is approximately 3.45 millimeters. The diameter of pin 136 is approximately 0.76 millimeters and the pin extends approximately 2.73 millimeters beyond the end of conductor 130.

The interconnect includes two terminals, one for the inner conductor and one for the outer conductor. The first terminal includes a formed wire 140, which is preferably constructed from 0.381 millimeter diameter beryllium-copper wire and gold plated to a thickness of approximately 1.5 micrometers. Formed wire conductor 140 is formed into five functional segments 142*a, b, c, d* and *e*. The two flexible attaching segments 142*a* and 142*b* each have a large radii bend and three right angle bends near each end of the wire. The ends of the wire are inserted into and soldered to plated through holes 108*a* and 108*b* of printed circuit board 102. The large radii bends in flexible attaching segments 142*a* and 142*b* allow the terminal to flex in the "X" direction. (The "X", "Y" and "Z" axes illustrated in FIG. 1 are mutually perpendicular.) Adjoining flexible attaching segments 142*a* and 142*b* are two substantially parallel pin contact segments 142*c* and 142*d* which are joined together by a joining segment 142*e*.

The second terminal of the interconnect includes a substantially flat flexible conductor 144 which is preferably constructed from 0.178 millimeter thick beryllium-copper and gold plated to a thickness of approximately 1.5 micrometers. Flexible conductor 144 has a "U" shaped lug 146 at one end and a well known "snap ring" or "C-clip" 148 at the other end. After connector 126 is inserted into aperture 122 of housing part 120, conductor 144 is attached to the connector by inserting snap ring 148 into groove 132. When snap ring 148 is installed in groove 132, connector 126 is retained within aperture 122 of housing part 120.

One side of a rectangular frame with a central opening (not illustrated) is attached to housing part 120 by screws. Printed circuit board 102 is then secured to the frame by screws. In attaching printed circuit board 102 to the frame, pin 136 of RF connector 126 slides in between pin contact segments 142*c* and 142*d* of first terminal 140, and "U" shaped lug 146 is positioned over large plated through hole 104. Joining segment 142*e* generates a clamping force on pin 136, thereby electrically connecting inner conductor 128 and pin 136 with wire formed terminal 140 and the electrical circuit pattern of printed circuit board 102. Therefore, pin 136 and formed wire conductor 140 provide an inner conductor connecting means for providing an electrical connection between inner conductor 128 and the electrical circuit pattern on printed circuit board 102.

Flexible conductor 144 is then secured to printed circuit board 102 by inserting a fastener (not illustrated), such as a screw or a bolt, through the opening in lug 146 and anchoring it into large plated through hole 104. This electrically connects outer conductor 130 of connector 126 with flexible terminal 144 and the electrical circuit pattern of printed circuit board 102. Thus, flexible terminal 144 and groove 132 provide an outer conductor connecting means for providing an electrical connection between outer conductor 130 and the electrical circuit pattern on printed circuit board 102.

If there is any misalignment between printed circuit board 102 and housing part 120 (or connector 126) in the "Z" direction, the first terminal is self-aligning because of the length of pin 136. A good contact between pin contact segments 142*c* and 142*d*, and pin 136 will be formed regardless of the particular point on pin 136 that the contact is made. Stated another way, pin 136 can slide up and down ("Z" direction) relative to formed wire terminal 140 to adjust for dimensional variations in the "Z" direction. If the housing part 120 and printed circuit board 102 are misaligned in the "X" direction, flexible segments 142*a* and 142*b* bend, allowing the pin contact segments 142*c* and 142*d* to move in the "X" direction, thereby compensating for any misalignment in the "X" direction. If housing part 120 and printed circuit board 102 are misaligned in the "Y" direction, pin contact segments 142*c* and 142*d* allow for such misalignment because of their length. A good contact between pin 136 and pin contact segments 142*c* and 142*d* is provided regardless of the particular point on the pin contact segments that the contact is made. Stated differently, formed wire terminal 140 can slide back and forth ("Y" direction) relative to pin 136 to adjust for dimensional variations in the "Y" direction.

With regard to the second terminal or flexible conductor 144, the interconnect also compensates for dimensional variations in any one or combination of the three directions. If housing part 120 and printed circuit board 102 are misaligned in the "Z" direction, flexible conductor 144 will bend to compensate for any dimensional variations in the "Z" direction. If housing part 120 and printed circuit board 102 are misaligned in the "Y" direction, lug 146 will merely be repositioned on the fastener. Stated another way, the fastener (before its tightened down) will slide back and forth ("Y" direction) within the opening of "U" shaped lug 146 and good electrical contact will be made regardless of the position relative to the lug where the fastener is finally tightened down. If housing part 120 and substrate 102 are misaligned in the "X" direction, flexible conductor 144 merely rotates around the fastener at the lug end and around outer conductor 130 at the snap ring end.

Thus, it can be seen that substantial misalignment of printed circuit board 102 and connector 126 or housing part 120 is permitted in any direction without breaking the electrical contacts between the substrate circuit pattern and connector 126.

We claim as our invention:

1. A triaxial self-aligning interconnect for connecting a circuit substrate to a connector, said interconnect comprising in combination:

a wire conductor formed into five segments: two flexible attaching segments formed at the ends of said wire for attaching said wire conductor to said substrate, two substantially parallel pin contact segments adjoining said flexible attaching segments, and a joining segment mutually connecting said pin contact segments; and a substantially straight pin attachable to said connector, said pin being clamped between and substantially perpendicular to said pin contact segments of said wire conductor, thereby forming an electrical connection between said pin and said wire conductor;

whereby, substantial misalignment of said substrate and said connector is permitted in any direction without breaking said electrical connection.

2. A triaxial self-aligning interconnect for connecting a circuit substrate to a connector, said connector including a first conductor having a pin and a second conductor having a groove, said interconnect comprising in combination:

a first terminal including a wire conductor formed into five segments: two flexible attaching segments formed at the ends of said wire for attaching said first terminal to said substrate, two substantially parallel pin contact segments adjoining said flexible attaching segments, and a joining segment mutually connecting said pin contact segments;

whereby, a first electrical connection is formed between said first conductor of said connector and said first terminal when said pin is inserted between said pin contact segments;

a second terminal including a flexible conductor having a "U" shaped lug at one end for fastening to said substrate and a snap ring at an opposite end for engagement with said groove of said coaxial connector;

whereby, a second electrical connection is formed between said second conductor of said connector and said second terminal when said snap ring is inserted into said groove of said connector, and substantial misalignment of said substrate and said connector is permitted in any direction without breaking said first and second electrical connections.

3. A triaxial self-aligning interconnect, comprising in combination:

a housing having an aperture;

a connector positioned in said housing aperture and having a groove;

a substrate having an electrical circuit pattern;

a flexible conductor having a flat lug with a "U" shaped slot at one end fastened to said substrate and a snap ring at an opposite end engaged with said groove of said connector, thereby forming an electrical connection between said connector and said substrate circuit pattern, retaining said connector within said aperture and attaching said connector to said housing;

whereby, substantial misalignment of said substrate and said connector is permitted in any direction without breaking said electrical connection.

4. A triaxial self-aligning interconnect, comprising in combination:

a housing having an aperture;

a coaxial connector positioned in said housing aperture and having inner and outer concentric conductors, said inner conductor includes a pin that extends beyond the end of said outer conductor;

a substrate having an electrical circuit pattern;

inner conductor connecting means for providing an electrical connection between said inner conductor and said substrate circuit pattern, said inner conductor connecting means includes a wire conductor attached to said substrate at the ends of said wire conductor and formed into five segments: two flexible segments formed near the ends of said wire, two substantially parallel pin contact segments adjoining said flexible segments wherein said pin is positioned between said pin contact segment, and a joining segment mutually connecting said pin contact segments and generating a clamping force on said pin;

outer conductor connecting means for providing an electrical connection between said outer conductor and said substrate circuit pattern;

whereby substantial misalignment of said substrate and said housing is permitted in any direction without breaking said electrical connections between said substrate and said inner and outer conductors.

5. A triaxial self-aligning interconnect, comprising in combination:

a housing having an aperture;

a coaxial connector positioned in said housing aperture and having an inner and outer concentric conductors, said outer conductor has an external circumferential groove;

a substrate having an electrical circuit pattern;

inner conductor connecting means for providing an electrical connection between said inner conductor and said substrate circuit pattern; and outer conductor connecting means for providing an electrical connection between said outer conductor and said substrate circuit pattern, said outer conductor connecting means includes a flexible conductor having a flat lug with a "U" shaped slot at one end fastened to said substrate and a snap ring at an opposite end engaged with said groove of said coaxial connector, whereby said coaxial connector is retained within said aperture and attached to said housing by said flexible conductor;

whereby substantial misalignment of said substrate and said housing is permitted in any direction without breaking said electrical connections between said substrate and said inner and outer conductors.

6. A triaxial self-aligning interconnect, comprising in combination:

a housing having an aperture;

a coaxial connector inserted into said housing aperture and having a flange to position said connector in said aperture, said connector having inner and outer concentric conductors, said inner conductor having a pin that extends beyond the end of said outer conductor and said outer conductor having an external circumferential groove;

a substrate having an electrical circuit pattern and a hole;

a wire conductor attached to said substrate and electrically connected to said substrate circuit pattern at the ends of said wire conductor, said wire conductor being formed into five segments: two flexible segments formed near the ends of said wire, two substantially parallel pin contact segments adjoining to said flexible segments wherein said pin is positioned between said pin contact segments, and a joining segment mutually connecting said pin contact segments and generating a clamping force on said pin, thereby forming an electrical connection between said inner conductor and said substrate circuit pattern;

a substantially flat flexible conductor having a "U" shaped lug at one end and a snap ring at an opposite end engaged with said groove of said coaxial connector, whereby said coaxial connector is retained within said aperture of said housing by said flat conductor; and a fastener inserted into said hole of said substrate, attaching said lug to said substrate and forming an electrical connection between said outer conductor and said substrate circuit pattern;

whereby, substantial misalignment of said substrate and said connector is permitted in any direction without breaking said electrical connections.

* * * * *